United States Patent [19]

Stamm

[11] Patent Number: 4,728,296

[45] Date of Patent: Mar. 1, 1988

[54] ELECTRICAL ADAPTOR FOR DOWNHOLE SUBMERSIBLE PUMP

[76] Inventor: Bradley C. Stamm, P.O. Box 240, Sandia, Tex. 78383

[21] Appl. No.: 905,767

[22] Filed: Sep. 5, 1986

[51] Int. Cl.[4] ..... H01R 13/52

[52] U.S. Cl. ..... 439/275; 439/277; 439/465

[58] Field of Search ..... 339/59 M, 60 M, 61 M, 339/89 R, 89 M, 94 R, 94 A, 94 C, 94 M, 103 C, 107, 111; 439/320-323, 271-277, 465

[56] References Cited

U.S. PATENT DOCUMENTS

| | | | |
|---|---|---|---|
| 2,383,926 | 8/1945 | White | 173/361 |
| 2,563,712 | 8/1951 | Frei et al. | 173/328 |
| 2,605,315 | 7/1952 | Hargett | 339/94 M |
| 3,124,405 | 3/1964 | Massa | 339/60 |
| 3,335,396 | 8/1967 | Nava et al. | 339/94 M |
| 3,390,371 | 6/1968 | Kramer | 339/107 |
| 3,466,590 | 9/1969 | Sylvester | 339/14 |
| 3,789,346 | 1/1974 | De Brick | 339/89 R |
| 3,945,700 | 3/1976 | Didier | 339/59 M |
| 4,005,922 | 2/1977 | Burkhart et al. | 339/107 |
| 4,166,664 | 9/1979 | Herrmann, Jr. | 339/111 |
| 4,193,655 | 3/1980 | Herrmann, Jr. | 339/31 |
| 4,241,967 | 12/1980 | Collins | 339/59 |

*Primary Examiner*—John McQuade
*Attorney, Agent, or Firm*—G. Turner Moller

[57] ABSTRACT

An electrical connector is used in a pumping oil well to deliver electrical power to a submersible pump. The connector includes a rigid housing having two bearing assemblies allowing relative rotational movement between parts of the housing to allow the upper housing end to threadably connect to a feed through socket and to allow the lower housing end to be rotated to axially compress a resilient dielectric conductor seal body between a pair of rigid dielectric alignment bodies.

20 Claims, 7 Drawing Figures

ELECTRICAL ADAPTOR FOR DOWNHOLE SUBMERSIBLE PUMP

This invention relates to an electrical connector-/adaptor used to provide a heavy duty electrical power circuit leading to a submersible downhole pump.

There are several standard techniques for recovering hydrocarbon liquids from wells penetrating the earth. The standard oil field pumping unit includes a downhole pump, a pump jack at the surface and a sucker rod string interconnecting the downhole pump and pump jack for manipulating the pump in response to movement of the pump jack. Although this type pumping unit is the most common pumping installation in the oil field, its use is limited to relatively low volume situations. As higher pumped volumes are required, the selection becomes choice between a gas lift installation and a submersible downhole pump. A gas lift installation involves the use of a gas compressor at the surface which receives low pressure gas from the well and compresses it to a higher pressure. The high pressure gas is delivered down the annulus of the well and through a series of gas lift valves into the tubing string where the formation liquid is aerated and lifted to the surface. A submersible downhole pump, on the other hand, is a pump which is lowered into the well on the end of the tubing string and powered in order to pump the formation liquid upwardly through the tubing string. There are pros and cons to the use of gas lift installations and submersible pumps involving trade offs between the pumped volume desired, the amount of capital costs and the amount of operating costs. Any particular selection depends on the facts of the case.

Submersible pumps are divided into two types, those powered by electricity and those powered by a liquid pumped down the annulus between the tubing and casing strings. This invention relates to electrically powered downhole submersible pumps and the heavy duty, high amperage circuit required to deliver power in sufficient quantity to pump the very large volumes of formation liquid that are desired. Electrically powered downhole pumps have their primary application in situations where 500 to 30,000 barrels of formation liquid are pumped each day. The amount of power consumed depends on the volume of pumped liquid, the height that the liquid is lifted and the efficiencies of the system. Although the operating voltage of any particular situation may vary, it is not uncommon to use 2400 volt, three phase, 60 cycle alternating current.

There are many requirements and many difficulties in delivering large amounts of electrical power through a cable extending into the earth to depths of 1,000–10,000 feet. Electrically powered downhole pumps have been in use for about 40 years and, obviously, most of the problems associated with their use have been resolved to one degree or another. The typical installation involves a source of electrical power at the surface, either a generator or a sub-station type connection to existing power lines. Electrical lines extend from the power source to a well head or Christmas tree on the well being pumped. In the most commonly used well head connection, the cable runs through the well head and is not cut. In more recent, more sophisticated approaches, the surface electrical lines comprise an armored power cable which terminates at the well head and attaches to a connector or adaptor plugged into a mandrel inserted in the well head. A connector or adaptor plugs into the bottom of the mandrel and attaches to an armored power cable strapped on the outside of the tubing string. The armored power cable extends into the well and typically connects, at the bottom of the tubing string, to the electric motor comprising part of the submersible pump. In some situations, the armored power cable extends downwardly into the well to a packer where it connects to a mandrel extending through the packer. In these situations, another armored cable segment connects to the packer mandrel and extends to the electric motor.

This invention relates to the connectors or adaptors that plug into the mandrel in the well head or in the packer, connect to the surface and/or downhole armored power cables and provide the ends thereof. There are several requirements for these type connectors or adaptors. First, they must isolate the electrical connection in the power supply cable from high pressure liquid hydrocarbons and salt water from the formation. It is not sufficient that these adaptors provide such isolation initially, or for short periods of time. It is a requirement that this isolation be effective for extended periods so pumping of the wells can continue uninterrupted for many months. Preferably, the adaptors should have such long operating lives that no shutdowns occur because of them and that repair or replacement of the adaptors may be done while the well is being worked over for other reasons.

Second, the adaptors are preferably of simple, rugged construction which allows repair and maintenance in the field as contrasted to merely replacing all adaptors in use for a substantial period of time and shipping them to a central repair facility. Such field repair procedures should be simple, involving such things as the replacement of O-rings, rubber seals, and the like. Third, installation of the adaptors should be as foolproof as possible.

It will become evident that this invention has particular application to oil field situations to provide high voltage, high amperage power to a submersible down hole pump. Although the invention will be described in connection with its oil well submersible pump application, it will be understood that it may be employed in other situations which require electrical connection of substantial electrical power in an environment of high pressure liquids and gases.

One recent approach to providing high power electrical connectors was to attach a short piece of cable under factory conditions to the connector and ship the connector and pig tail cable end to the field. Oil field workers then spliced the cable end to the cable extending downwardly into the well. It is a small miracle that any of these splices were satisfactory. In truth, most of them were quite satisfactory. A small but significant proportion of such field splices were unsatisfactory requiring the well to be worked over.

In response to this problem, there have been proposed electrical connectors or adaptors of the type contemplated herein, of which U.S. Pat. No. 3,945,700 is exemplary. Of more general interest are the disclosures of U.S. Pat. Nos. 2,383,926; 2,563,712; 3,124,405; 3,466,590; 4,193,655 and 4,241,967. It will suffice for present purposes to note that existing connectors or adaptors for supplying power to downhole submersible pumps have their disadvantages or drawbacks, which the present invention attempts, in part, to overcome.

The electrical connector of this invention can be attached to an armored cable end under typical oil field conditions of poor light, high winds, very hot or very cold temperatures, much dust and greasy hands with much less difficulty than splicing and with much greater assurance of subsequent reliable operation than prior art connectors or, in particular, splicing.

Certain conventions of descriptive language are used herein, both in the specification and in the claims, for purposes of clarity and convenience and not with any purpose of implying limitation to the oil well art, or to a vertical disposition of parts as is usually the situation with oil field casing. The terms "upstream" and "downstream" are used to refer to the coupling and cable attachment ends of the connector. In a typical well head installation, the upstream end is upward and upstream with respect to the delivery of electrical power although it is usually downstream with respect to the direction of upwardly pumped oil or water. Correspondingly, at such an installation, the downstream end of the connector is downward relative to the upstream end, downstream in the direction of electrical power delivery but upstream relative to the pumped formation fluids.

The terms "feed through", "feed through socket", "mandrel" and the like are adopted from the terminology used in describing well heads in oil well technology in order to describe generally, without restriction to oil well technology, the kind of electrical socket for which the electrical connector of this invention was designed.

In summary, the adaptor of this invention comprises a housing having a generally cylindrical upper portion divided into a pair of threadably connected sections. The upper or upstream section includes a contactor support body having a plurality of conductive contactor tubes therein for connection to electrical contacts of the feed through socket or mandrel of the well head, packer or the like. The contactor support body is preferably of resilient dielectric material and is coupled to the mandrel by a threaded coupling which axially advances the contactor tubes toward the mandrel contacts. The contactor support body may be provided with upstream contactors of either male or female structure to accommodate male or female feed through sockets. The lower or downstream end of the contactor support body includes a series of openings providing access to the contactor tubes by male fittings provided on the ends of the electrical conductors comprising part of the cable.

Abutting the resilient contactor support body is a first rigid dielectric alignment body having a series of passages therethrough, one for each of the conductors of the cable. A second rigid dielectric alignment body is spaced from the first alignment body and provides a like series of passages aligned with the passages of the first alignment body. A resilient dielectric conductor seal body is disposed between the alignment bodies and includes passages aligned with the passages of the alignment bodies. The insulated conductors of the cable, with the armor and dielectric jacket removed, extend through the aligned passages of the alignment bodies and conductor seal body.

The lower part of the housing is threadably coupled to the upper part and relative threading movement causes the alignment bodies to approach one another, much like press platens, to compress or squeeze the conductor seal body between them. This compression of the conductor seal body is sufficient, without the use of adhesive or thermal bonding, to seal each of the insulated conductors from the other and from the entry of high pressure gases and liquids caused by the immersion of the connector in an oil well environment.

A peculiar feature of the housing is the provision of a pair of bearing assemblies in the upstream housing end which allows relative rotation between the central part of the housing and the upper part thereof. In addition, a bearing assembly allows relative rotation between the contactor support body and the housing.

It is an object of this invention to provide an improved connector or adaptor to provide an electrical connection in a high voltage, high amperage situation subject to exposure to high pressure gases or liquids.

Another object of this invention is to provide an improved connector or adaptor of the high voltage, high amperage type which can be readily assembled, disassembled and repaired in the field.

Other objects and advantages if this invention will become more fully apparent as this description proceeds, reference being made to the accompanying drawings and appended claims.

Figure 1:
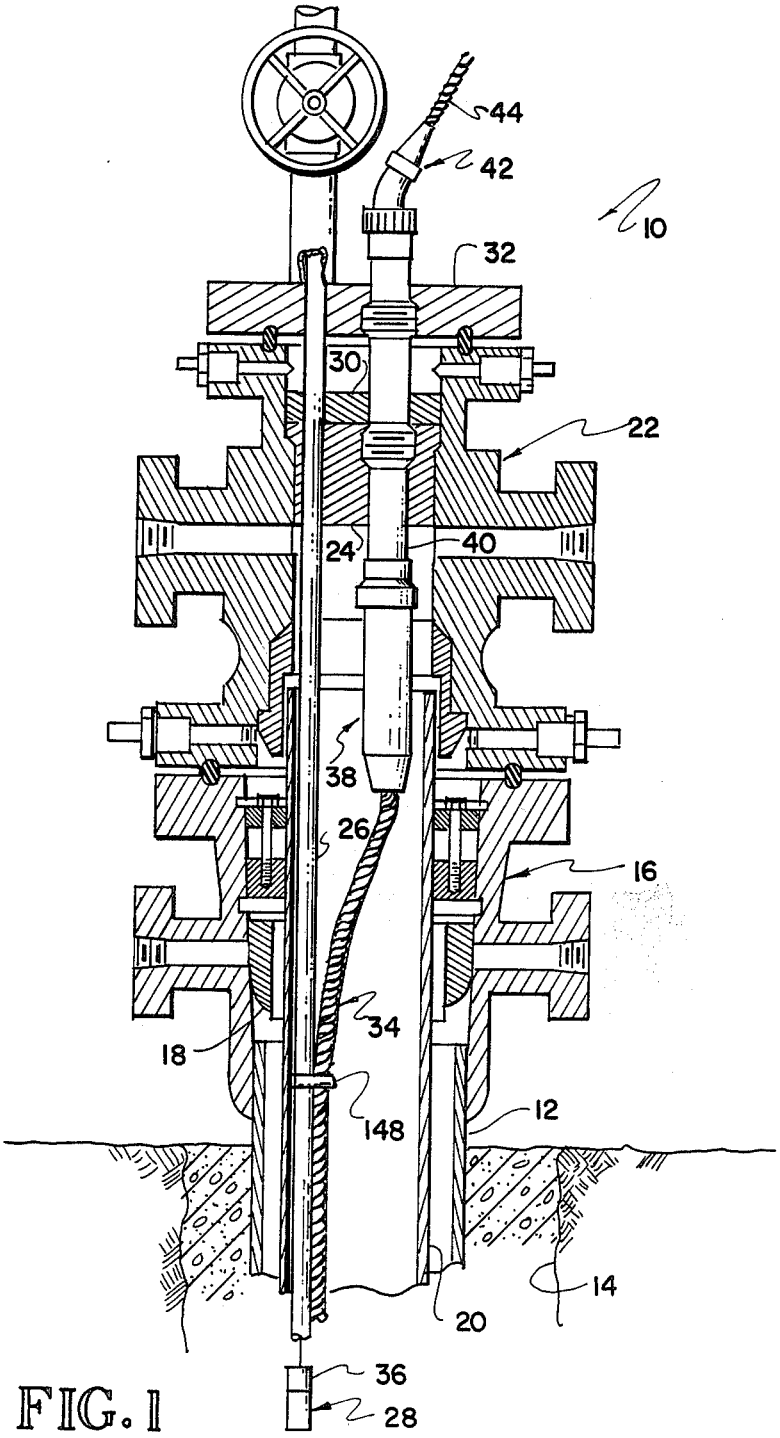
FIG. 1 is an enlarged cross-sectional view of a well equipped with a downhole submersible pump and an electrical supply system incorporating the connector or adaptor of this invention.
Figure 2:
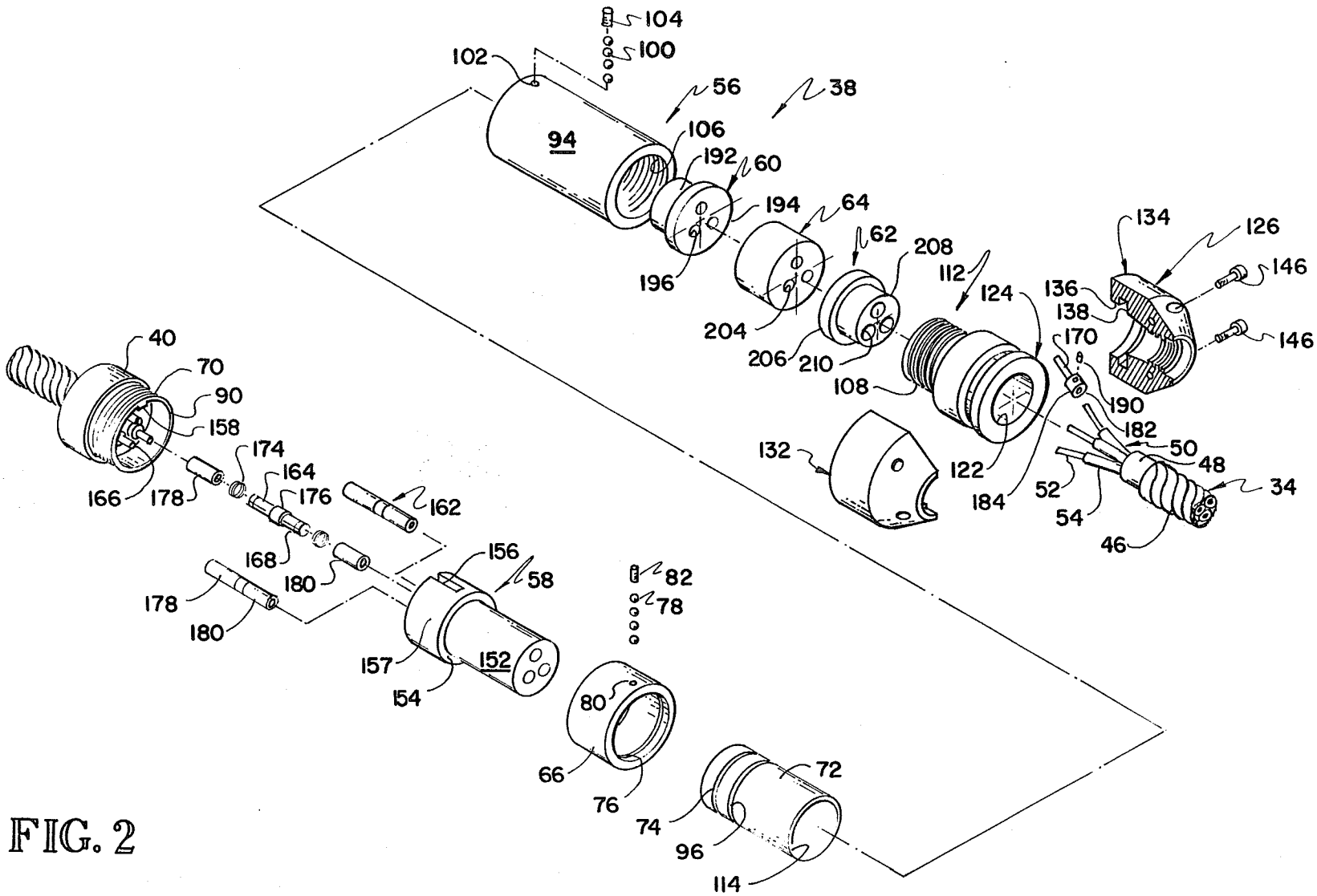
FIG. 2 is an enlarged exploded isometric view of the connector of this invention.
Figure 3:
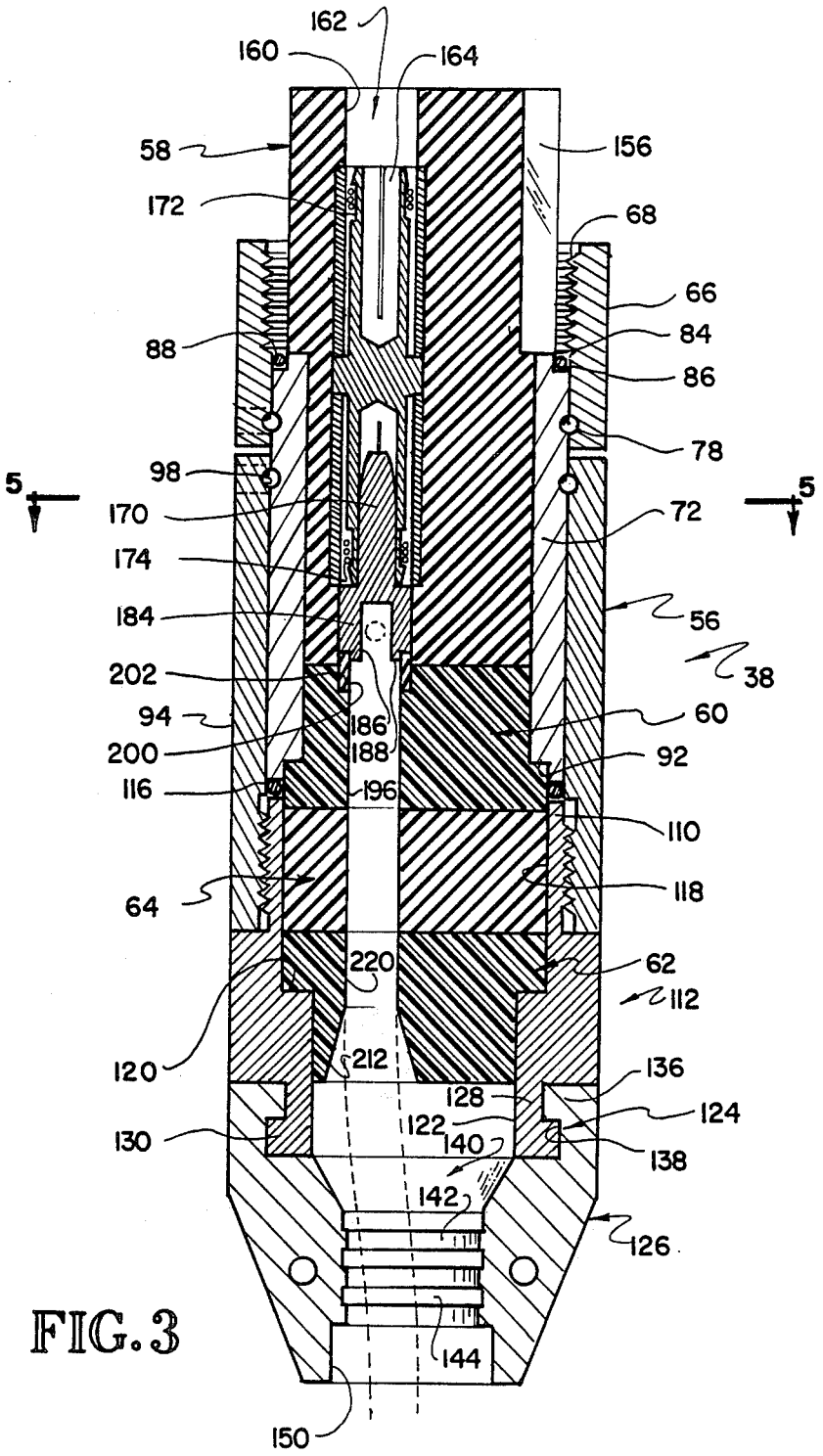
FIG. 3 is an enlarged longitudinal cross-sectional view of the connector of this invention.

Referring to FIGS. 1–3, there is illustrated a well 10 comprising a string of surface pipe 12 cemented in the upper portion of a bore hole 14 which extends into the earth to a location adjacent and usually below a subterranean oil productive formation (not shown). A bradenhead 16 attaches to the surface pipe 12, usually threadably or by welding. A set of slips 18 suspends a casing string 20 inside the bore hole 14 which is also cemented in place. A casing head 22 connects to the upper end of the casing string 20 and includes a tubing hanger 24.

A tubing string 26 is suspended from the tubing hanger 24 and extends downwardly inside the casing string 20 to a location adjacent the productive formation. An electrically powered submersible pump 28, of any suitable type, on the lower end of the tubing string 26 pumps oil or an oil-water mixture from the inside of the casing string 20 upwardly through the tubing string 26. A conventional sealing arrangement 30 seals about the exterior of the tubing string 26 and a flange type closure 32 closes the top of the external well head assembly of the well 10.

Electric power is delivered to the downhole pump 28 through an armored cable 34 connected to a motor 36 comprising part of the submersible pump 28. The cable 34 extend upwardly in the well 10 to a connector or adaptor 38 of this invention located immediately below the tubing hanger 24. The connector 38 is secured to a mandrel or feed through socket 40 extending through the hanger 24, seal assembly 30 and flange 32. A pig tail connector 42 attaches the mandrel 40 to a power cable 44 extending to a source of power at the surface. Those skilled in the art will recognize this description of the well 10, except for the connector 38, as being that of a conventional well and well head assembly using a downhole submersible pump.

The cable 34 is illustrated as being of conventional type including an outer armor covering 46 and a sheath or jacket of somewhat flexible dielectric material 48 enclosing a plurality of insulated conductors 50 each of which includes a central metallic core or wire 52 and an outer insulating covering 54. The dielectric material 48 is, in present commercially available cable, typically a nitrile rubber composition. Because the amperage carried to the motor 36 is quite large, the size of the central conductive wire or core 52 is impressively large, usually a size 4. In connecting the cable 34 to the adaptor 38 of this invention, the ends of the central wires 52 are cut generally square and the insulating covering 54 is cut back a short distance from the wire end, usually about ½ inch. The armor covering 46 is cut back from the wire end about 5 inches and preferably filed smooth. The nitrile jacket 48 is then cut off about ¾ inch from the end of the armor covering 46. The armor covering 46 is generally typically metallic, but it will be evident that organic polymeric materials may become commonplace in the near future.

Referring to FIGS. 2 and 3, the connector or adaptor 38 of this invention is illustrated in greater detail. The adaptor 38 comprises, as major components, a housing 56, a contactor support body 58, a pair of spaced apart alignment and compression bodies 60, 62 and a conductor seal body 64 located between the alignment bodies 60, 62. As will become more fully apparent hereinafter, the alignment bodies 60, 62 are forced toward each other to compress the conductor seal body 64 against the outer surface of the insulating coverings 54 of the various conductors 50 and against the inner surface of the housing 56. Compression of the seal body 64 also compresses the insulating covering 54 onto the wire 52 thereby making the covering 54 seal better against the wire 52. These seals are preferably accomplished without the use of bonding agents, such as adhesives, high temperature and the like.

The housing 56 is of generally cylindrical shape and comprises an upstream section 66 of cylindrical shape having interior threads 68 on the uppermost end thereof for connecting the housing 56 and thus the connector 38 to complementarily shaped male threads 70 on the downstream end of the mandrel or feed through socket 40. An inner housing sleeve 72 connects to the upstream section 66 by the provision of complementary grooves 74, 76 in the sleeve 72 and section 66 respectively which contain a multiplicity of ball bearing elements or spheres 78. It will thus be seen that the grooves 74, 76 and spheres 78 comprises a ball bearing assembly connecting the section 66 to the sleeve 72 and allowing relative rotation therebetween. The sleeve 72 and section 66 are assembled by pouring the spheres 78 through a threaded passage 80 in the section 66 until the grooves 74, 76 are more-or-less full and then closing the passage 80 with an Allen or set screw 82.

The uppermost end of the inner sleeve 72 is of reduced diameter providing a pair of O-ring sealing surfaces 84, 86 where an O-ring seal 88 resides for sealing against the bottom surface 90 of the mandrel 40 and the inner surface of the upstream housing section 66. The housing inner sleeve 72 also includes a radially inner annular groove or slot 92 on the downstream end thereof for purposes more fully pointed out hereinafter.

The housing 56 also includes a generally cylindrical central section 94 overlapping the inner sleeve 72 and connected therewith by a ball bearing assembly comprising a pair of aligned grooves 96, 98 filled with ball bearing elements or spheres 100. A threaded passage 102 extends through the central section 94 to intersect the grooves 96, 98. The spheres 100 may be inserted through the passage 102 to fill the grooves 96, 98. An Allen or set screw 104 closes the passage 102 and retains the spheres 100 in place to allow for relative rotation between the sleeve 72 and the central housing section 94 for purposes more fully pointed out hereinafter. It will also be seen that the grooves 96, 98 and spheres 100 act to couple the sleeve 72 to the central section 94.

The lower or downstream end of the central section 94 includes internal threads 106 for connection to exterior threads 108 of a sleeve 110 comprising part of a housing nut 112. The upper end of the threaded sleeve 110 is, in its fully made up condition, spaced slightly from the downstream surface 114 of the sleeve 72 to receive an O-ring 116 therebetween. The inside of the housing nut 112 provides a passage 118 of generally circular cross-section having an annular shoulder 120 reducing the size of the passage 118 to that of a smaller cylindrical passage 122.

The downstream end of the housing nut 112 includes a hanger structure 124 from which depends a separable cable clamp 126. The hanger structure 124 includes a depending sleeve 128 integral with the housing nut 112 and a radially extending circular rim 130. The cable clamp 126 is made of two mirror image halves or sections 132, 134 each of which includes an upper inwardly extending semi-circular rim 136 and groove 138 receiving the rim 130 of the hanger structure 124. The interior of the cable clamp 126 provides a passageway 140 merging at the upstream end with the passage 122 and including an intermediate section having a series of circular raised ribs 142 alternating with circular depressions 144 for gripping the exterior surface of the dielectric jacket 48 of the cable 44. The cable clamp halves 132, 134 are joined together by transversely extending threaded fasteners 146. Coupling the cable clamp halves 132, 134 together acts to compress the jacket 48 adjacent the ribs 142 and depressions 144 thereby immobilizing the cable 34. It will be seen that the cable clamp 126 supports a length of the cable 34 above the first strap 148 which attaches the cable 34 to the tubing string 26. The end of the armor 46 of the cable 34 is preferably located inside a lower cavity 150 provided by the cable clamp 126 to provide a neat armor end.

The contractor support body 58 is quite similar to that disclosed in U.S. Pat. No. 3,945,700, largely because it fits in and connects to the downstream end of the conventional mandrel 40. The body 58 is made of a resilient dielectric material such as Neoprene. This is a moldable elastomeric rubber-like material having excellent resistance to oil, fuels, lubricants, mineral acids and many aliphatic and aromatic hydrocarbons. It is available in various hardness ratings and is capable of withstanding relatively high temperatures for impressive periods of times. Although it is a preferred material at this time, it will be understood that more desirable materials may be developed and employed with this invention as the opportunity arises.

The body 58 substantially fills the upstream end of the housing 56 and includes a downstream generally cylindrical end 152 closely received in the axial passage provided by the inner housing sleeve 72. An annular shoulder 154 on the exterior of the body 58 abuts the upper end of the sleeve 72. A keyway 156 in the enlarged upper end 157 of the body 58 engages a key 158 on the mandrel 40 to guide the contactor support body 58 linearly toward the mandrel 40 when the adaptor 38 is being coupled thereto.

Although the embodiment of FIGS. 2 and 3 provides male contactors on the mandrel 40 and female contactors on the adaptor 38, it will be understood that this relationship may be reversed if necessary. As illustrated, the contactor support body 58 includes a plurality of longitudinally extending passages 160, one for each of the conductors 50 of the cable 34. Inside each of the passages 160 is a contactor tube assembly 162 having a set of upstream fingers 164 providing a central passageway for receiving a male connector pin 166 of the mandrel 40. A similar set of downstream fingers 168 provide a central passageway for receiving a male connector pin 170 comprising part of each of the insulated conductors 50. Each set of fingers 164, 168 provides a notch 172 on the outer side thereof receiving a helical spring 174 biasing the fingers into electrical contact with the pins 166, 170 thereby assisting in retaining the pins 166, 170 in place.

The contactor tube assembly 162 includes an enlarged central section 176 onto which is secured, as by soldering or the like, a pair of sleeves 178, 180 extending upstream and downstream respectively about the exterior of the finger sets 164, 168. The sleeves 178, 180 protect the fingers 164, 168 and allow easy insertion of the tube assemblies 162 into the passages 160. The fingers 164, 166 and central section 176 of the tube assembly 162 are electrically conductive to provide an electrical path through the contactor tube support 58. Conveniently, the sleeves 178, 180 are metallic.

Received in the downstream fingers 166 of each of the contactor tube assemblies 162 is a male conductor comprising the terminal pin end 170 and a collar 184 integral therewith. The collar 186 provides a central passage 186 receiving the bared end of the wire or core 52 of the cable 44. As shown best in FIG. 3, the end 188 of the collar 184 is of smaller diameter than the remainder of the collar 184 for purposes more fully set forth hereinafter. Desirably, the insulating covering 54 extends upstream to juxtapose the end 188 of the collar 184. A set screw 190 or other suitable means secures the bared end inside the collar 184.

Abutting the contactor support body 58 is a first alignment body 60 made of a rigid dielectric material, such as fiberglass filled TEFLON. This type material is called an EGC Alloy 71 and uses short milled glass fibers as the filler. The body 60 includes an upstream end 192 sized to be closely received in the passage of the inner sleeve 72 and a downstream annular rim 194 abutting the shoulder 92 on the downstream end of the sleeve 72. The outer diameter of the rim 194 is sufficiently small to compress the O-ring 116 against the inner surface of the central section 94. A series of passages 196 are provided through the body 60, one for each of the insulated conductors 50. Each one of the passages 196 is aligned with one of the passages 160 of the contactor support body 58.

Figure 4:
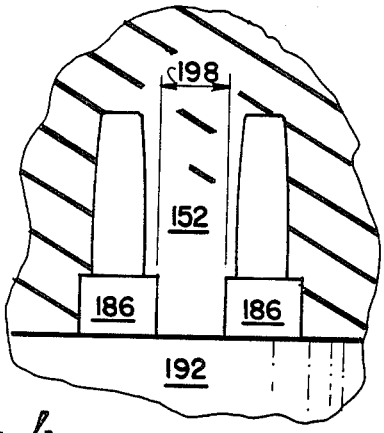
FIG. 4 is an enlarged cross-section view of a modified connector, illustrating one advantage of the embodiment of FIGS. 2 and 3.
Figure 5:
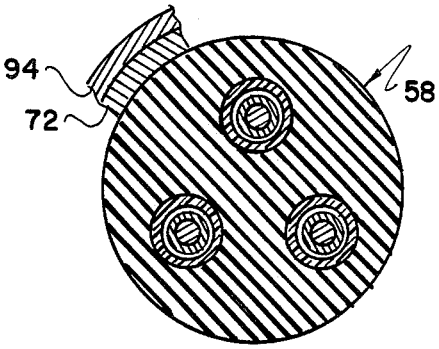
FIG. 5 is an enlarged transverse cross-sectional view of the connector of this invention, taken substantially along line 5—5 of FIG. 3, as viewed in the direction indicated by the arrows.

One of the subtleties of this invention resides in the construction adjacent the junction of the contactor support body 58, which is a resilient dielectric material, and the first alignment body 60, which is a rigid dielectric material. If this junction were planar, as shown in FIG. 4, the distance an electric arc would have to pass would be the shortest distance 198 in a plane between the collars 186. Instead, the collars 186 are offset inside the resilient contactor support body 58 by a rigid dielectric sleeve 200 extending from inside an enlarged upper end 202 of the passage 196. Thus, for an arc to occur between adjacent collars 186, the path has to be longitudinally along the end of the sleeve 200 to the junction of the bodies 58, 60, transverse along this junction to the next adjacent sleeve 200 and then longitudinally along the end of the sleeve 200 adjoining the adjacent conductor 50. This is manifestly a longer, more difficult electrical path and minimizes the occurrence of arcing between adjacent conductors 50 at the junction of the contactor support body 58 and the first alignment body 60.

As is evident in FIG. 3, the downstream collar end 188 of the male conductor 182 is small enough to be received inside the sleeve 200 and the shoulder adjacent the collar end 188 resides on top of the sleeve 200. This has a variety of functions. First, the clearance between the collar end 188 and the sleeve 200 is fairly close providing a more solid connection. Second, this close fit centers the pin end 170 relative to the passage 196 through the first alignment body 60 and thus to the passage 160 in the contactor support body 58.

The conductor seal body 64 is a generally cylindrical piece of resilient dielectric material, such as Dupont VITON. The conductor seal body 64 should be hard enough to withstand high pressures without excessive extrusion yet soft enough to allow sealing deformation to occur. It turns out that standard VITON, with a durometer a hardness of about 70, is quite satisfactory. The body 64 is of substantially the same diameter as the rim 194 of the first alignment body 60 and is closely received by the internal passage of the sleeve 110 of the housing nut 112. A plurality of passages 204 extend through the conductor seal body 64, one for each of the insulated conductors 50.

The second alignment body 62 is located wholly within the housing nut 112 and is made of a rigid dielectric material, such as the fiberglass filled TEFLON discussed previously. The body 62 includes an upstream rim 206, substantially the same diameter as the seal body 64, received in the enlarged passage 118. A section 208 of the body 62 is located in the smaller passage 122 of the housing nut 112. A series of passages 210 extend through the body 62, one for each of the insulated conductors 50, and align with the passages 160, 196, 204. The downstream ends 212 of the passages 210 are preferably flared to allow some bending of the insulated conductors 50 without damaging them.

The axial extent of the alignment bodies 60, 62 and the conductor seal body 64 are selected so that threadable advance of the housing nut 112 into the central housing section 94 compresses the conductor seal body 64 into sealing engagement, on the exterior thereof, with the inside of the passage 118 through the sleeve 110. Similarly, the conductor seal body 64 is compressed into sealing engagement, on the interior of the passages 204, with the exterior of the insulating covering 54 of the conductors 50.

It is believed that installation and operation of the adaptor 38 is now apparent. With the well 10 killed and the downhole equipment in place, a technician strips the armor 46 off the cable 34 to a location corresponding to the bottom cavity 150 of the hanger 126, strips off the insulating jacket 48 corresponding to a location inside the cavity between the bottom of the second alignment body 62 and the top of the alternating ribs 142 and depressions 144, and strips the insulating covering 54 off the last half inch or so of each insulated conductor 50. Each of the insulated conductors 50 is passed through its passage of the alignment bodies 60, 62 and the conductor seal body 64. The male conductors 182 are then attached to the bared ends of each conductor 50. The conductor pins 170 are aimed into the open downstream ends of the passages 160 while the bodies 60, 62, 64 are passed through the open bottom of the housing 56. The housing nut 112 is threaded into the lower end of the central housing section 94 and the nut 112 tightened while advancing the conductors 50 toward the contactor support body 58 to make contact between the conductor pin 170 and the contactor tube assembly 162 while compressing the conductor seal body 64 between the alignment bodies 60, 62. After the housing nut 112 is in place, the cable hanger 126 is clamped about the exterior of the jacket 48 so that the end of the armor 46 resides in the cavity 150. The assembled adaptor 38 is then plugged into the lower end of the feed through socket 40 and the remainder of the well 10 assembled as shown in FIG. 1.

Although the adaptor 38 is eminently suited for use inside the well 10, because of its ability to withstand high pressure fluids, it may also be used in lieu of the pig tail connector 42 merely by changing the cable clamp 126, which is separable from the housing. There are also situations where the adaptor 38 is useful, above and/or below a packer, to connect to a feed through socket extending through the packer. Another intriguing feature of the adaptor 38 is that different sized cable can be accommodated merely by changing the cable clamp 126 and the bodies 60, 62, 64.

It is preferred to use Dupont VITON as the resilient dielectric material in the contactor support body 58. The difficulty is that the contactor support body 58 is supposed to be bonded to the sleeve 72 by a bonding agent. The VITON material, when liquified to be molded, is of such high viscosity that it removes the bonding agent from the inside of the sleeve 72 when pumped thereinto. Consequently, the only successful contactor support bodies 58 made to date have been from Neoprene.

Figure 6:
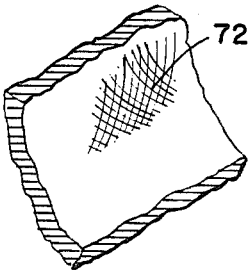
FIG. 6 is a partial view of the inside of a housing sleeve of another embodiment of this invention.

In response to this problem, it is proposed that the interior surface of the sleeve 72 be grooved, knurled or the like as suggested in FIG. 6 to provide indentations to receive and retain the bonding agent when the liquified VITON is pumped into the mold, of which the sleeve 72 is part. By this technique there is a greater likelihood that bonding agent will remain on the inner surface of the sleeve 72 and thereby bond the sleeve to the contactor support body 58.

Figure 7:
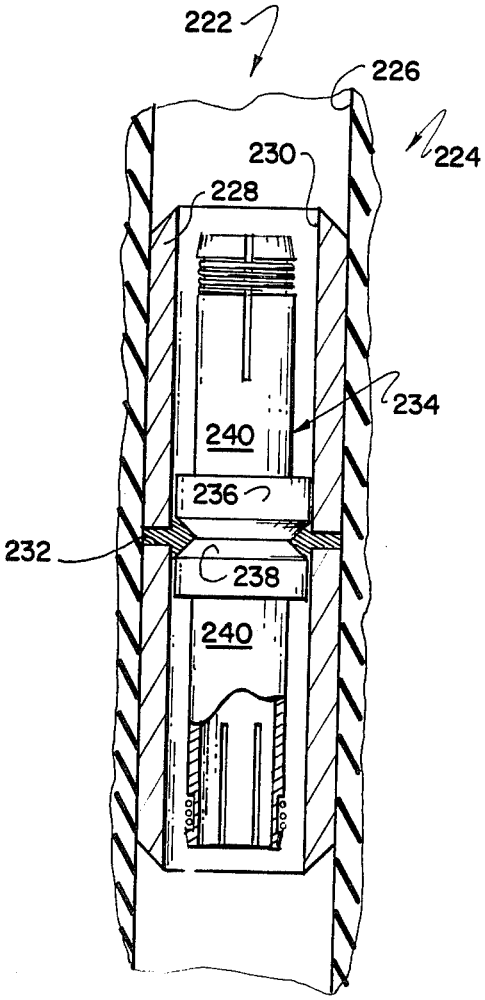
FIG. 7 is an enlarged cross-sectional view of another embodiment of a component of the connector of this invention.

Referring to FIG. 7, there is illustrated another technique for making a contactor tube assembly 222 and assembling it in a contactor support body 224. After it is molded, the contactor support body 224 is substantially identical to the support body 58 and includes a plurality of passages 226 extending therethrough, one for each of the conductors. The contactor tube assemblies 222 each include a metallic or electrically conductive tube 228 having a central passage 230 extending axially therethrough and at least one and preferably two or more small transverse passages 232 intermediate the ends of the tube 228. A double ended metallic female connector 234 is snuggly received in the passage 230 and includes a central boss 236 having a central circular slot 238 machined therein and a pair of oppositely facing prong receiving sockets 240.

A substantial advantage of the assemblies 222 lies in the improved assembly technique, as well as in a more reliable, leak proof construction. To assemble the construction of FIG. 7, the female connector 234 is press fit in the tube 228 so it is wholly received therein and equidistant from the tube ends. This positions the groove 238 adjacent the transverse passages 232. Heat is applied to the tube 228 adjacent the passages 232 and silver solder or the like is delivered through the passages 232 to fill the groove 238. This manifestly secures the connector 234 to the tube 228 but more importantly seals the joint therebetween to prevent any gases from migrating through the inside of the tube 228. The assembly 222 is then placed in a mold and the contactor support body 224 molded therearound. This produces a structure which is relatively simple to make and yet provides considerable protection against gases migrating on the inside of the tube 228 or on the outside thereof.

Although this invention has been described in its preferred forms with a certain degree of particularity, it is understood that this description is only by way of example, and that numerous changes in the combination and arrangement of parts may be resorted to without departing from the spirit and scope of this invention as pointed out in the appended claims.

I claim:

1. An electrical connector for connecting a cable having multiple insulated conductors to a feed through socket, comprising an elongate housing made of rigid material and having an axis, the housing having an upstream end and a downstream end;

means on the downstream end of the housing for gripping the exterior surface of the cable and immobilizing the cable;

means at the upstream end of the housing for securely connecting the electrical connector to the feed through socket;

a contactor assembly comprising a contactor support body made of a dielectric material substantially filling the upstream end of the housing;

an electrically conductive contactor tube, for each of the conductors, supported within the body, the tubes being aligned in an upstream-downstream direction and having a downstream opening for receiving one of the conductors of the cable, and an upstream electrical contactor portion for mating with a corresponding contactor in the feed through socket;

a pair of spaced rigid dielectric alignment bodies in the housing providing aligned pairs of passages for each of the insulated conductors, a first alignment body being juxtaposed to the contactor support body;

a resilient dielectric conductor seal body between the alignment bodies having a passage aligned with each of the aligned pairs of passages of the alignment bodies for receiving the insulated conductors therethrough; and means for axially moving the rigid alignment bodies toward each other for compressing the resilient conductor seal body against the insulated conductors.

2. The electrical connector of claim 1 wherein the alignment bodies and the conductor seal body being slidably received in the housing, the axial moving means comprising means for forcing the alignment bodies and the conductor seal body toward the contactor support body.

3. The electrical connector of claim 2 wherein the housing comprises a pair of sections and means threadably interconnecting the sections, the axial moving means comprising the threadable interconnecting means.

4. The electrical connector of claim 1 wherein the housing comprises an upstream section having a threaded portion, an inner sleeve and means rotatably mounting the upstream section on the inner sleeve, the means for connecting the electrical connector to the feed through socket comprising the upstream section threaded portion.

5. The electrical connector of claim 4 wherein the rotatable mounting means comprises aligned grooves in the upstream section and the inner sleeve and spherical bearing elements in the grooves.

6. The electrical connector of claim 5 wherein the rotatable mounting means further comprises a transverse passage, extending through the upstream section into the grooves, of a size large enough to pass the spherical bearing elements therethrough and means for closing the transverse passage.

7. The electrical connector of claim 6 wherein the transverse passage provides internal threads and the closing means comprises a threaded element threadably received in the internal threads.

8. The electrical connector of claim 1 wherein the housing comprises a central section having a threaded downstream end, an inner sleeve having a passage therethrough and means rotatably mounting the central section for rotation relative to the inner sleeve, a first of the alignment bodies and the contactor support body residing in the passage of the inner sleeve, the axial moving means comprising means threaded onto the threaded downstream end for moving a second of the alignment bodies and the conductor seal body toward the first alignment body.

9. The electrical connector of claim 8 wherein the threaded downstream end comprises an interiorly threaded downstream end and the means threaded onto the interiorly threaded downstream end comprises a housing nut having an exteriorly threaded sleeve providing a passage therethrough having a shoulder facing the upstream connector end, the conductor seal body being located in the sleeve passage and the second alignment body residing against the passage shoulder for moving the conductor seal body toward the upstream connector end in response to threading the housing nut onto the central section.

10. The electrical connector of claim 1 wherein the cable gripping means comprises a pair of mirror image separable halves, means separately suspending the separable halves on the downstream end of the housing and a plurality of fasteners securing the separable halves together.

11. The electrical connector of claim 10 wherein the suspending means comprises a depending sleeve and a radially outwardly extending circular rim on the housing and each of the separable halves comprises a radially inwardly extending upstream rim received on and supportably engaging the radially outwardly extending circular housing rim.

12. The electrical connector of claim 1 wherein the housing comprises an upstream section having a threaded portion, an inner sleeve having a passage therethrough, means rotatably mounting the upstream section on the inner sleeve, a central section having a threaded downstream end, means rotatably mounting the central section for rotation relative to the inner sleeve, a first of the alignment bodies and the contactor support body residing in the passage of the inner sleeve, the axial moving means comprising means threaded onto the threaded downstream end, the means for connecting the electrical connector to the feed through socket comprising the upstream section threaded portion.

13. The electrical connector of claim 3 wherein the contactor support body comprises a resilient dielectric material having a generally planar downstream end, the upstream end of the first alignment body comprises a generally planar surface having a plurality of rigid dielectric sleeves extending toward the upstream connector end from the alignment body surface, each of the sleeves being concentric with the passages through the first alignment body.

14. The electrical connector of claim 2 wherein the contactor support body is made of a resilient material and includes a generally planar downstream end, the upstream alignment body includes an upstream end having a generally planar upstream surface and a rigid dielectric sleeve received in each of the passages and projecting upstream further than the alignment body upstream surface, the upstream surface of the upstream alignment body and the downstream surface of the contactor support body being forced together by the axial moving means.

15. The electrical connector of claim 1 wherein the contactor support body comprises a resilient dielectric material having a plurality of axially extending passages therethrough, each of the passages having therein an electrically conductive tube providing an axially extending passage and at least one transverse passage intermediate the ends thereof, a double ended female connector in the passage having a central boss providing a groove adjacent the transverse passage, and solder means in the groove and transverse passage securing and sealing the female connector to the tube.

16. In combination, an electrical connector, a feed through socket and a cable having multiple insulated conductors including a board end having a conductor pin thereon, a dielectric jacket around the conductors terminating subtantially short of the bared end and an armor sheath around the jacket terminating substantially short of the dielectric jacket, comprising an elongate housing made of rigid material and axially aligned with the cable, the housing having an upstream end connected to the socket and a downstream end adjacent the cable;

means on the downstream end of the housing gripping the exterior surface of the dielectric jacket and immobilizing the cable;

a contactor assembly comprising a contactor support body made of a dielectric material substantially filing the upstream end of the housing;

an electrically conductive contactor tube, for each of the conductors, supported within the body, the tubes being aligned in an upstream-downstream direction and having a downstream opening receiving the conductor pin of the conductor, and an upstream electrical contactor portion for mating with a corresponding contactor in the feed through socket;

a pair of spaced rigid dielectric alignment bodies providing a plurality of aligned pairs of passages, each passage pair receiving one of the insulated conductors, one of the alignment bodies abutting the contactor support body;

a resilient dielectric conductor seal body between the alignment bodies having a passage aligned with each of the aligned pairs of passages of the alignment bodies and receiving one of the insulated conductors; and means for axially moving the rigid alignment bodies toward each other and compressing the resilient conductor seal body against the insulated conductors.

17. The combination of claim 16 wherein the alignment bodies and the conductor seal body being slidably received in the housing, the axial moving means comprising means for forcing the alignment bodies and the conductor seal body toward the contactor support body.

18. The combination of claim 17 wherein the contactor support body is made of a resilient material and includes a generally planar downstream end, the upstream alignment body includes an upstream end having a generally planar upstream surface and a rigid dielectric sleeve received in each of the passages and projecting upstream further than the alignment body upstream surface, the upstream surface of the upstream alignment body and the downstream surface of the contactor support body being forced together by the axial moving means.

19. The combination of claim 18 wherein the conductor pin comprises a collar having a blind opening therein receiving the bared conductor end, a set screw coupling the bared conductor end to the collar, and a male pin of smaller cross-sectional size than the collar extending away from the collar, the collar having a section of reduced cross-sectional size adjacent the downstream end thereof providing a shoulder, the shoulder residing on the upstream end of the rigid dielectric sleeve, the section of reduced cross-sectional area residing inside the rigid dielectric sleeve.

20. The combination of claim 16 wherein the contactor support body comprises a resilient dielectric material having a plurality of axially extending passages therethrough, each of the passages having therein one of the electrically conductive tubes providing an axially extending passage and at least one transverse passage intermediate the ends thereof, a double ended female connector in the passage having a central boss providing a groove adjacent the transverse passage, and solder means in the groove and transverse passage securing and sealing the female connector to the tube.

* * * * *